US006446853B1

(12) United States Patent
Schmodde et al.

(10) Patent No.: US 6,446,853 B1
(45) Date of Patent: Sep. 10, 2002

(54) FRICTION FEED WHEEL MECHANISM WITH VIBRATION EXCITATION

(75) Inventors: Hermann Schmodde, Horb-Dettlingen; Christoph Worner, Baiersbronn, both of (DE)

(73) Assignee: Memminger-IRO GmbH (DE)

( * ) Notice: Subject to any disclaimer, the term of this patent is extended or adjusted under 35 U.S.C. 154(b) by 0 days.

(21) Appl. No.: 09/783,486

(22) Filed: Feb. 14, 2001

(30) Foreign Application Priority Data

Feb. 15, 2000 (DE) ..... 100 06 599

(51) Int. Cl.[7] ..... B65H 23/16; B65H 51/20; D04B 15/48

(52) U.S. Cl. ..... 226/34; 66/132 T; 226/174; 226/193; 242/364.9

(58) Field of Search ..... 226/34, 174, 193; 66/132 R, 132 T; 242/364.9

(56) References Cited

U.S. PATENT DOCUMENTS 4,058,245 A 11/1977 Hurt et al.
4,346,551 A * 8/1982 Yanobu et al. ..... 242/155 R
4,673,139 A * 6/1987 Memminger et al. ..... 66/132 R
5,388,747 A * 2/1995 Chen ..... 226/174
6,079,234 A * 6/2000 Hsiung ..... 226/174
6,145,347 A * 11/2000 Plath ..... 66/132 T

FOREIGN PATENT DOCUMENTS

DE 2326132 12/1974

* cited by examiner

*Primary Examiner*—Michael R. Mansen
(74) *Attorney, Agent, or Firm*—Leydig, Voit & Mayer, Ltd.

(57) ABSTRACT

A vibration friction feed wheel mechanism for feeding thread to a thread processing machine having intermittent thread requirement. The feed wheel mechanism including a high friction contact surface, a thread guide level for lifting thread off of the feed wheel and a vibration generating arrangement for applying a vibrational movement to the thread. The vibration of the thread ensures that the thread lifts-off from the contact surface of the friction feed wheel by reducing the coefficient of friction between the thread and the high friction contact surface of the friction wheel.

18 Claims, 9 Drawing Sheets

FRICTION FEED WHEEL MECHANISM WITH VIBRATION EXCITATION

FIELD OF THE INVENTION

The invention relates to a friction feed wheel mechanism with vibration excitation.

BACKGROUND OF THE INVENTION

So-called friction feed wheel mechanisms are often employed for feeding thread to thread-processing machines, in particular those, which have a chronologically fluctuating or intermittent thread requirement. These have a thread feed wheel, which is driven at a constant number of revolutions and has a contact surface for the thread. The thread is wrapped around the thread feed wheel at a wrap angle which is mostly less than 360°. The thread is moreover conducted through the eye of a thread guide lever, wherein the position of the lever affects the wrap angle. The thread guide lever is usually pre-stressed away from the thread feed wheel by means of a spring force. When the use of thread by the thread-processing machine ends, the thread guide lever slightly lifts the thread off the thread feed wheel or reduces the wrap angle, so that the thread feeding is stopped. Thus, the thread usage controls the thread feeding.

The coefficient of friction which prevails between the thread and the contact surface is important for the functioning of such a friction feed wheel mechanism. In actual use, the coefficient of friction changes because of matter being carried along by the thread, such as oil, wax or other materials and being deposited on the contact surface. Because of this, as well as because of the aging of a possible friction lining, for example a plastic material or rubber, the feeding properties of the device slowly change. If the coefficient of friction between the friction lining and the thread is large, the thread tends to adhere to the friction lining. The result of this can be that the friction-controlled switch-off, i.e. the stoppage of feeding by the friction feed wheel mechanism, does not take place correctly. For example, the thread is not detached from the drum when the thread guide lever is pivoted out and its feeding is therefore continued. Even if the thread is detached from the friction lining, damage of the thread and/or of the friction lining can occur because of the remaining contact between the thread and the thread lining of the rotating drum during extended periods of stoppage of the thread. Rubber linings are particularly endangered. Too low a coefficient of friction, however, can interfere with the reaction properties of the friction feed wheel mechanism, if a thread feed suddenly occurs and thread must again be fed in following a feeding stop.

A friction feed wheel mechanism is known from U.S. Pat. No. 4,058,245 which, in view of the above mentioned problems, is provided with a special thread feed wheel. The thread feed wheel has a contact surface which is designed, for example, as a meander-shaped annular groove. In another embodiment, the contact surface is constituted by spokes of a wheel or by pins attached to a wheel, which are arranged crosswise, viewed in the circumferential direction, and are inclined at an acute angle in respect to the radial direction. A thread placed around the wheel lies in a zig-zag shape between the pins or spokes.

The division of the contact surface into individual surfaces and the zig-zag-shaped thread placement lead to conditions which differ from those occurring in connection with thread feed wheels which are coated with a plastic material or rubber and are essentially cylinder-shaped. Such friction feed wheel mechanisms are also dependent on the friction between the contact surface and the thread in regard to their reaction properties. The friction, in turn, is a function of the yarn type and the thread type.

OBJECTS AND SUMMARY OF THE INVENTION

Based upon the foregoing, it is the object of the invention to produce an improved friction feed wheel mechanism.

The friction feed wheel mechanism in accordance with the invention has a vibration generating device, which acts on the thread. This is accomplished, for example, in that it is connected with the thread guide lever, the thread feed wheel, a thread guide element or any other element touching the thread.

In this way the detachment of the thread from the contact surface of the thread feed wheel is made considerably more easy, in particular in case of a feed stop, and the remaining contact between the thread and the thread feed wheel is minimized.

If the thread adheres to the contact surface, it is possible to overcome the static friction by means of the vibration applied to the thread, the thread guide element, the thread feed wheel or the thread guide lever or other element, which considerably improves the removal properties (switching the thread feed off). This applies in particular, but not exclusively, to thread feed wheels having a coating with a large coefficient of friction or a structured surface, which permits good thread feeding. Moreover, this applies in particular to threads having a large coefficient of friction. A further advantage lies in that deposited dirt, which possibly can lead to adherence, such as sizing, oil or the like, does not lead, or leads less, to adherence of the thread. The step of exposing the contact between the thread and the thread feed wheel to a certain vibration, therefore drastically improves the thread removal, i.e. the disruption of the thread feed wheel which takes the thread along.

Because of the application of vibration to the thread it is possible for the latter to be lifted off the thread feed wheel almost completely when the thread is standing still, wherein at most a small area of contact between the thread and the thread feed wheel remains, in which the thread then rests against the thread feed wheel without or under only little tension. Because of this, long thread idle times are possible without damage to the thread or to the thread feed wheel.

The feed wheel mechanism in accordance with the invention can be employed for various threads with differing frictional properties. Because of the vibrational reinforcement, the correct functioning is not sensitive to changes in the coefficient of friction.

In the embodiment of the invention, the thread guide lever can be designed as a pivot lever, as well as a resilient hoop, or as any other shape. It is essential that it supports a thread guide element, whose position in respect to the thread feed wheel can be affected by the thread tension. In a simple manner, rigid levers permit the setting of a force which pre-stresses the lever, for example by means of a tension spring, whose point of suspension is adjustable. The setting of the force permits the matching to different thread tensions and thread qualities. Resiliently designed levers, however, lead to particularly simple structures. In both embodiments, the respective lever is attached to a seating device ("second seating device") at its end remote from the thread guide element. If the lever is rigid, the second seating device allows a movable, for example pivotable, seating. Independently thereof, the seating arrangement (pivot bearing or a rigid version) can be connected with the vibration generating device, which causes the thread guide lever, and therefore also the thread guide element supported by the thread guide lever, to vibrate. These vibrations can be transferred to a larger or lesser degree to the thread via the thread guide element.

Alternatively or additionally, the first seating device for the thread feed wheel and/or a thread guide element, which is arranged upstream or downstream of the thread feed wheel, can be connected with the vibration generating device. A vibrational movement is respectively caused, which can be transmitted to the thread. In this connection the vibrating movement can be directed as needed. Possible are, for example, oscillations transversely in respect to the respective axis of rotation, linearly in respect to the respective axis of rotation or pivot axis, or obliquely in respect to it. If the vibration generating device acts on the thread guide element, which is arranged upstream or downstream of the thread feed wheel, the direction of vibration can be directed transversely in respect to the thread and parallel with the axis of rotation of the thread feed wheel, or transversely to the latter. The vibration generator can basically also perform a superimposed oscillation, so that the respective vibrating element is not only guided (swings) on a linear, but also an elliptical or circular path. In this case the vibrating movement becomes an orbital movement with a small radius.

It is considered to be particularly practical to design the contact surface of the thread feed wheel in an interrupted fashion. The contact surface can be defined by several strips, spokes, teeth or pins, which determine a zig-zag-shaped thread course, for example. This embodiment not only has good reaction properties, but also good removal properties. This applies to a great extent independently of the type of the thread used.

A particularly operator-friendly structure results if both the inlet thread guide element, placed upstream of the thread feed wheel, and the outlet thread guide element, placed downstream of the thread feed wheel, are arranged to be accessible from the direction of the operating side of the thread feed device, and if both the thread guide element of the thread guide lever and the thread travel path on the thread feed wheel are fixed on a section of the circumference of the thread feed wheel which faces the operating side. Therefore the thread need not be conducted behind the thread feed device in the course of being threaded, which makes the operation considerably easier.

Advantageous details of the embodiments of the invention can be seen in the drawings or taken from the description, or are the subject of dependent claims. Exemplary embodiments of the invention are represented in the drawings. Shown are in:

While the invention will be described and disclosed in connection with certain preferred embodiments and procedures, it is not intended to limit the invention to those embodiments. Rather it is intended to cover all such alternative embodiments and modifications as fall within the spirit and scope of the invention.

DETAILED DESCRIPTION OF PREFFERED EMBODIMENTS

Figure 1:
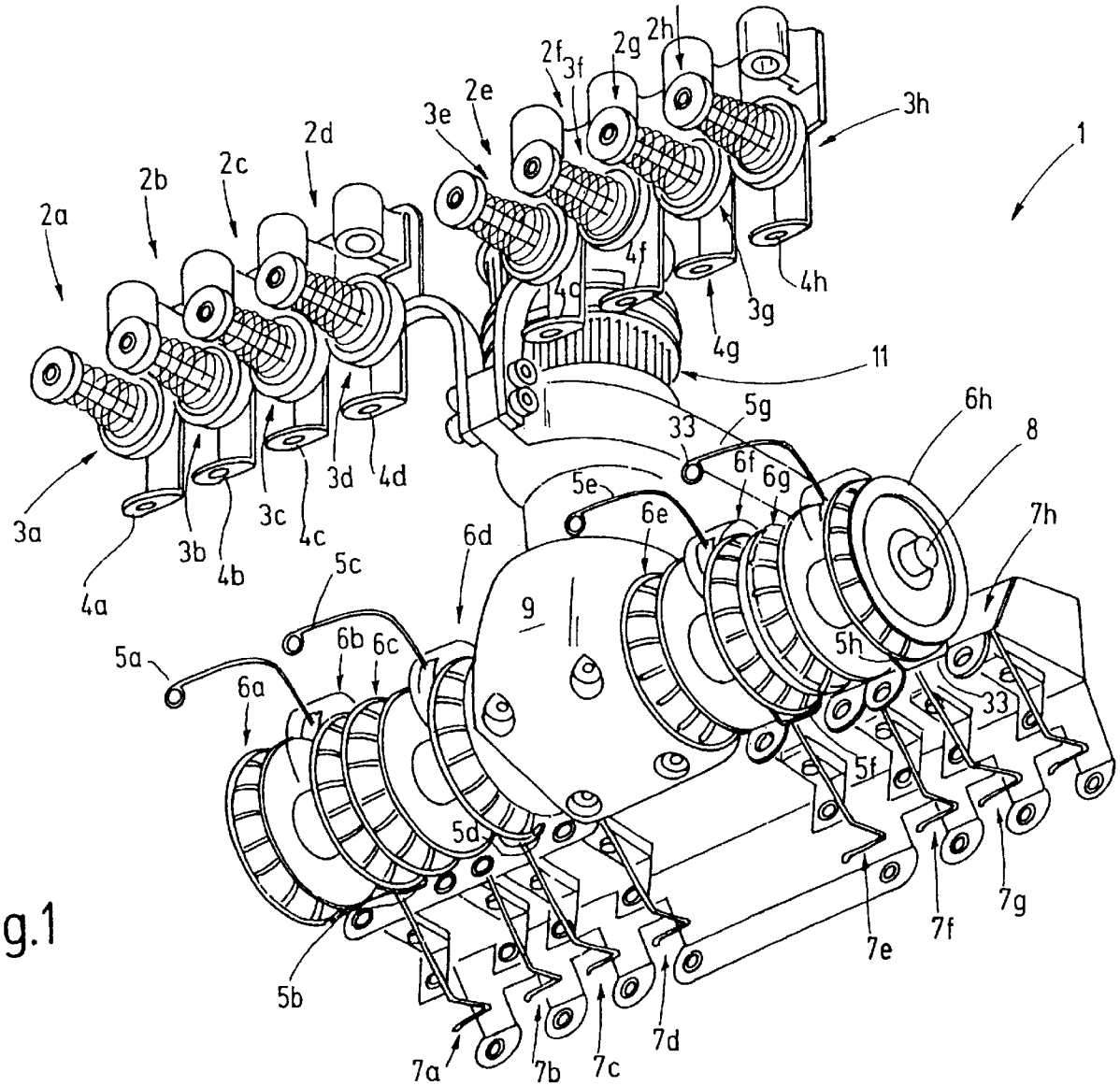
FIG. 1, a perspective representation of a vibration feed wheel mechanism for eight threads, FIG. 2, a schematic lateral view of the vibration feed wheel mechanism of FIG. 1 during the thread feeding process, FIG. 3, a schematic lateral view of the vibration feed wheel mechanism of FIGS. 1 and 2 during the removal of the thread, FIG. 4, a schematic lateral view of the vibration feed wheel mechanism of FIGS. 1 to 3 with a removed thread, FIG. 5, a perspective and partial representation of the vibration feed wheel mechanism of FIGS. 1 to 4, FIG. 5*a*, a perspective view of thread feed wheel of FIGS. 1 to 4.

A vibration feed wheel mechanism 1 is represented in FIG. 1, which has a total of eight thread feed tracks and therefore eight thread feed systems 2*a* to 2*h*, which are basically designed identical, and each of which has a thread brake 3, 3*a*–3*b* a thread guide eye 4, 4*a*–4*h*, a thread guide lever 5, 5*a*–5*h*, a thread feed wheel 6, 6*a*–6*h*, and thread guides eyes 7, 7*a*–7*h* on the outlet side. To distinguish them, the respective elements are identified by letter indices in FIG. 1.

The thread feed wheels 6*a* to 6*h* are supported on a common shaft 8, with which they are connected, fixed against relative rotation. The shaft 8 is rotatably seated by means of a bearing device, not shown in detail, held in a housing 9, and constitutes a support device for the thread feed wheel 6. In addition, the housing 9 contains an angular gear, whose power take-off side is the shaft 8, and whose input shaft supports pulleys 11 for driving the thread feed wheels 6*a* to 6*h*.

Figure 2:
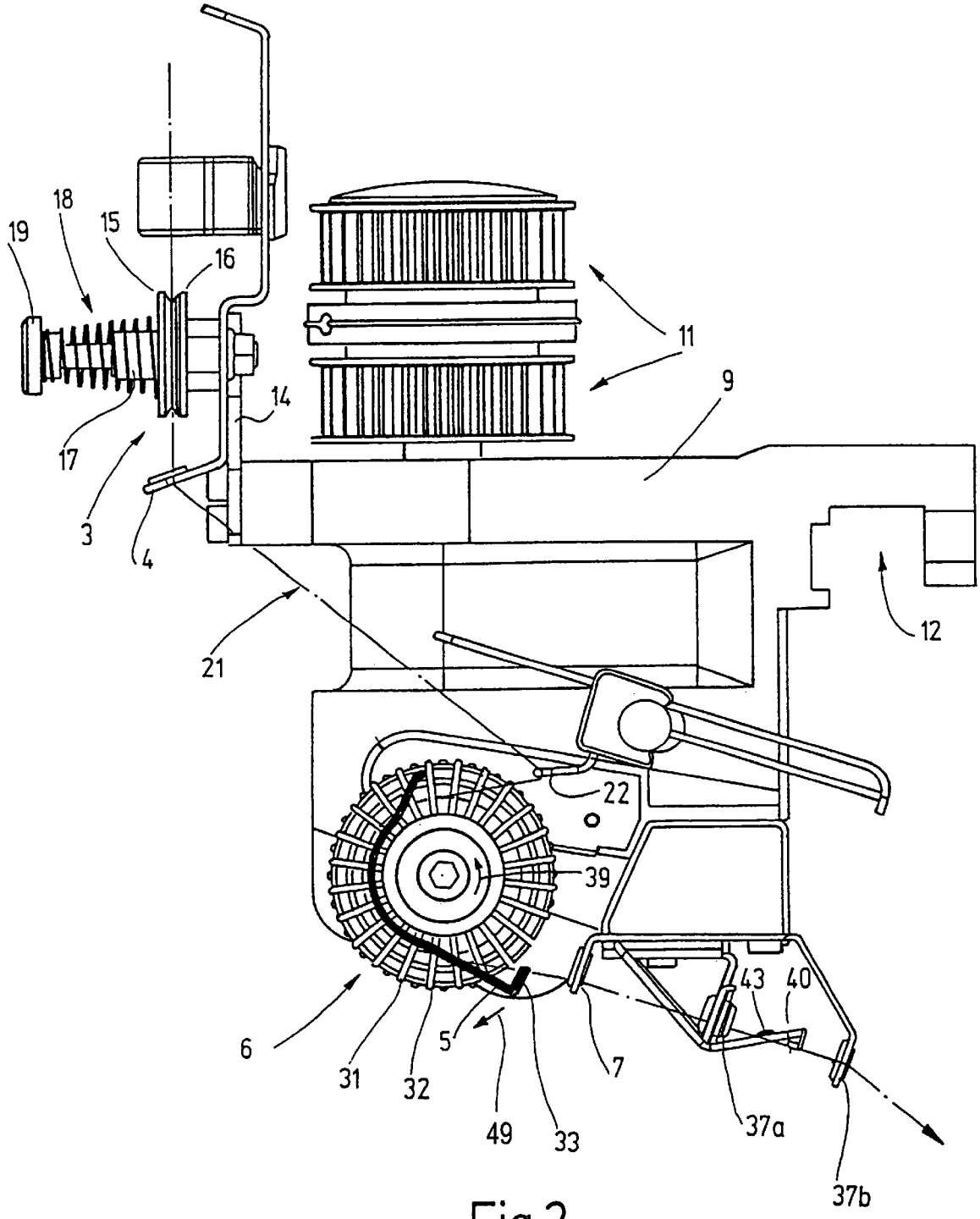

As FIG. 2 shows, the housing 9 is provided on one side with a clamping device 12 for fastening the vibration feed wheel mechanism 1 on a thread-processing machine, for example a circular knitting machine or other knitting machine. The same as the respective pulleys of further feed wheel mechanisms, the pulleys 11 are in connection with a circulating belt and are driven by it. The thread feed systems 2*a*–2*h* of the vibration feed wheel mechanism 1 are identical with each other. Therefore the following description of the thread feed system 2*h* represented in FIG. 2 correspondingly applies to all thread feed systems 2*a, b, c, d, e, f, g*, for which reason the letter indices have been left out to a great extent in the description which follows.

A brake support 14 is fastened on the housing 9 in an area of the operating side of the housing 9 which is remote from the clamping device 12. This support holds the thread brake 3. The latter is a disk brake with two brake disks 15, 16 seated on a common pin or peg 17. The brake disks 15, 16 are adjustably pre-stressed by means of a tension spring 18, which is supported on a knurled nut 19. However, other types of brakes, for example magnetically pre-stressed brakes, brakes acted upon by vibration, wrap-around brakes, or other devices braking the thread movement, can also be used.

In the immediate vicinity of the thread brake 3, the brake support 14 holds the thread guide eye 4, starting at which a thread 21, which is to be fed in, is conducted to a further eye 22. The latter is, as represented in particular in FIG. 5, embodied as an open hook with a ceramic insert 23. The eye 22 is maintained on a pivot arm 24, which is seated on the housing 9 and is pivotable around a pivot axis 25. The pivot arm 24 is connected via a journal 26 and a connecting rod with an eccentric 27, which is connected with the thread feed wheel 6 in a manner fixed against relative rotation. During each rotation of the thread feed wheel 6, the eye 22 therefore performs a short-stroke oscillating movement in the direction of the arrow P represented in FIG. 5.

The pivot arm 24, the connecting rod and the eccentric constitute a vibration generator 28. The pivot axis 25 is indicated parallel with the axis of rotation of the thread feed wheel 6, which is indicated by a dash-dotted line 29 in FIG. 6. The direction of the oscillating movement approximately corresponds to the direction of the thread 21 running to the thread feed wheel 6.

Alternatively or additionally, the thread guide eye 4, or another element which is in total or partial connection with the thread, can be connected with an electrical, electromagnetic or mechanical vibration generator, which operates continuously or when needed. With both embodiments (vibration of the eye 22 or vibration of the eye 4), vibration acts on the thread between the thread brake 3 and the thread feed wheel 6.

In principle, the thread feed wheel 6 can be designed in any arbitrary manner. For example, it can be constituted by a disk-shaped drum, on whose outer circumference an appropriate coating, for example a plastic material or a rubber coating, is provided. However, a spoked wheel is preferred, which is represented in part and somewhat simplified in FIG. 5*a*. On its outer circumference, this thread feed wheel 6 has a circumferential and groove-like depression, in which strips 31, 32 have been arranged, which alternate with each other and cross each other in the circumferential direction. In this case the strips 31, 32 are essentially arranged inclined in the radial direction, but toward the axis of rotation, and are spaced apart from each other. Adjoining strips 31, 32 do not touch, and enclose an angle with each other. This angle preferably is an acute angle, independently thereof the thread 21 resting on the thread feed wheel 8 follows a zig-zag-shaped course. The pins or strips 31, 32 define a repeatedly interrupted contact surface 38 for the thread 21.

As FIG. 2 shows, the thread 21 is additionally conducted through an eye 33, which is arranged at the free end of the thread guide lever 5. Here, the eye 33, or another thread guide element supported on the thread guide lever 5, is arranged at some radial distance from the axis of rotation 29 of the thread feed wheel 6, wherein the radial distance can be changed or adjusted by pivoting the thread guide lever 5.

Figure 5:
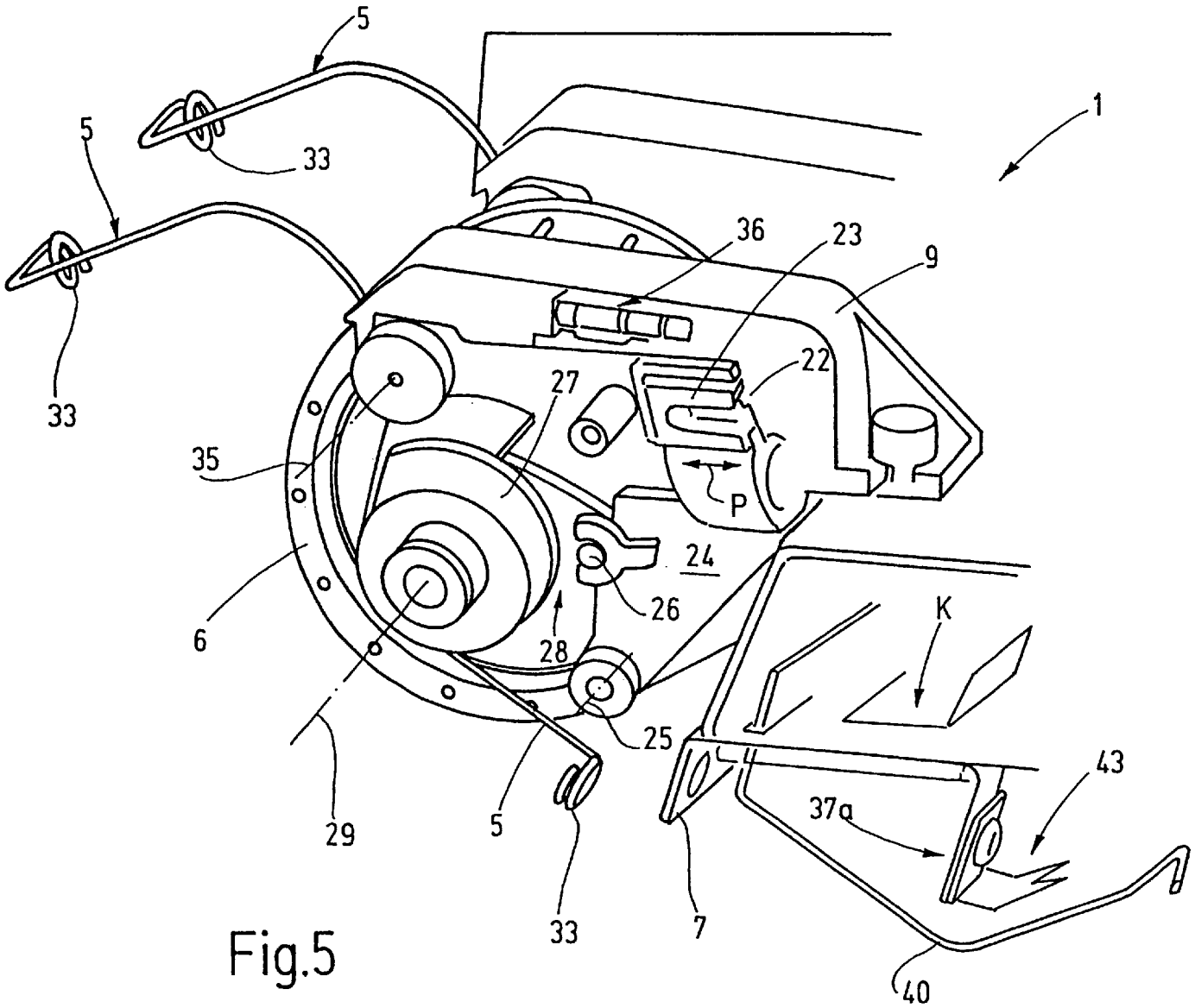
Figure 5A:
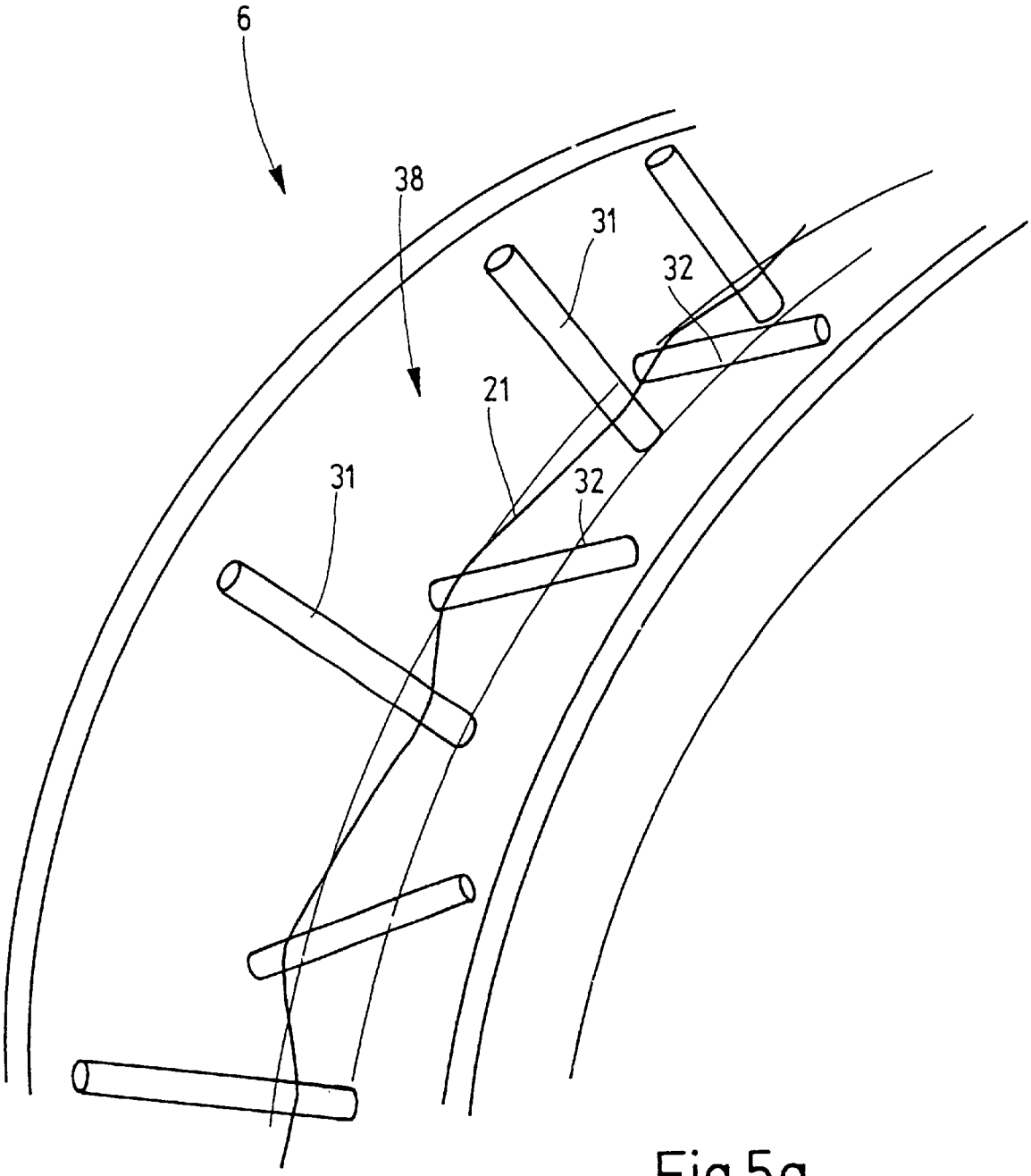

As shown in particular in FIG. 5, the thread guide lever 5 is pivotably seated around a pivot axis 35, which is oriented parallel with the axis of rotation 29 of the thread feed wheel 6. A spring mechanism 36 indicated in FIG. 5 here prestresses the thread guide lever 5 in a position, wherein its eye 33 is at the farthest possible distance from the thread feed wheel 6. The spring force is of such a size that the thread 21, when it is pulled in by the knitting machine, can pull the thread guide lever 5 to the thread feed wheel. The spring force and/or the pivot travel of the thread guide lever 5 can be adjustable for varying the thread outlet tension and/or for setting the vibration friction feed wheel mechanism for various types of thread.

The further thread track downstream of the thread feed wheel 6 is determined by the thread guide eye 7 and, if required, additional thread guide eyes 37*a*, 37*b*, through which the thread 21 is conducted. As can be seen in FIG. 5, a return safety device is embodied between the two thread guide eyes 37*a*, 37*b*, part of which are a pivotable switch-off lever 40 and a brake element 43, which has a V-shaped cut in a flat area, and which is arranged at an acute angle against the thread. Next to the brake element, a hook-shaped end of the switch-off lever, which protrudes out of the housing 9, rests on the thread 21. It other end is arranged in the housing and assigned to a switch-off contact K. The machine is turned off if the switch-off lever touches the switch-off contact K.

The brake element 43 is arranged in the immediate vicinity of the thread guide eye 37*a* in such a way that the thread 21, which is stretched tight between the thread guide eyes 37*a*, 37*b*, runs through the V-shaped cut without touching it. If the thread 21 is no longer tightly held between the thread guide eyes 37*a*, 37*b*, the switch-off lever 40 drops slightly downward and pushes the thread 21 into the V-shaped cut of the brake element 43. The thread 21 is clamped by this and prevented from running back. However, the switch-off lever 40 is not in any way touching the contact K. The machine is not switched off. The switch-off device only reacts if the switch-off lever 40 drops all the way down, which is the case with a completely detached thread or a ripped thread.

The vibration friction feed wheel mechanism 1 described so far operates as follows:

During operation, a circulating toothed belt, which is in contact with at least one of the pulleys 11, rotates the respective pulley 11 and in this way drives the shaft 8 with the thread feed wheels 6 via a gear, not represented in further detail. The thread 21 is conducted between the brake disks 15, 16 of the thread brake 3 and runs through the thread guide eye 4 to the eye 22. It will now be assumed that the thread-processing machine arranged downstream of the vibration friction feed wheel mechanism 1, i.e. a knitting machine, for example, requires thread and therefore maintains the thread 21, running from the thread guide eye 37*b* to the machine, tensed. The thread 21 is thus kept in contact with the repeatedly interrupted contact surface 38 of the thread feed wheel 6, and therefore in engagement with the thread feed wheel 6. In the course of this, the eye 33 is subjected to a (small) force, represented by an arrow 49 in FIG. 2, which attempts to lift the thread 21 off the thread feed wheel 6. However, as long as there is a sufficient consumption of thread by the downstream-connected machine, the thread guide lever 5 cannot do this—the thread 21 remains in engagement with the thread feed wheel 6 and is positively conveyed by the latter. This is represented in FIG. 2. The thread 21 is in engagement with the thread feed wheel 6 over a wrap angle of approximately 270°. The thread guide lever 5 is maintained by the thread 21 against the comparatively weaker force of the spring mechanism 36 (only schematically indicated in FIG. 5) in such a way that the eye 33 is located close to the circumference of the thread feed wheel 6.

Figure 3:
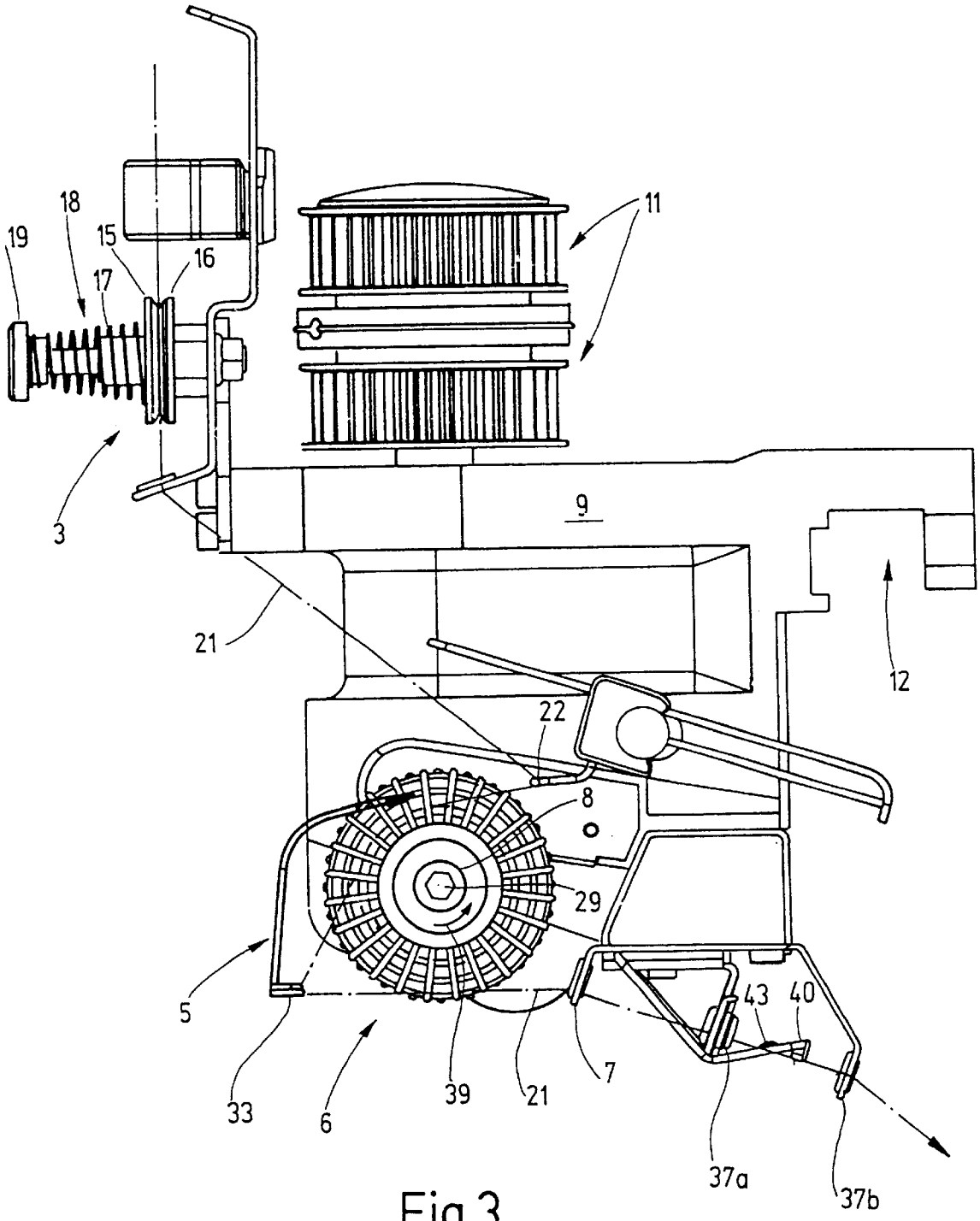

If the thread consumption of the downstream-connected machine is reduced, or is even stopped, the thread feed wheel 6 initially feeds in more thread than what runs through the thread guide eyes 7 and the thread guide eyes 37*a*, 37*b* to the machine. Therefore the thread guide lever 5 can pivot out because of the tension of its pre-stressing spring and can lift the thread 21 off the thread feed wheel 6, as illustrated in FIG. 3. The wrap angle of the thread 21 at the thread feed wheel 6 is clearly reduced. However, it is still possible to deliver a small amount of thread because of the frictional connection. In the intermediate pivot position represented in FIG. 3, the thread 21 touches the thread feed wheel 6, before running to the eye 33 of the thread guide lever 5. From there, the thread 21 reaches the thread guide eye 7 essentially without touching the thread feed wheel 6. The contact between the thread 21 and the thread feed wheel is small, without pressing the thread 21 against the thread feed wheel 6. With an appropriate arrangement of the eye 22 and the thread guide eye 7, the thread 21 can also be lifted completely off the thread feed wheel 6, so that in the removed state it no longer touches the latter. In both cases the thread 21 comes through even extended periods of stoppage without damage.

Figure 4:
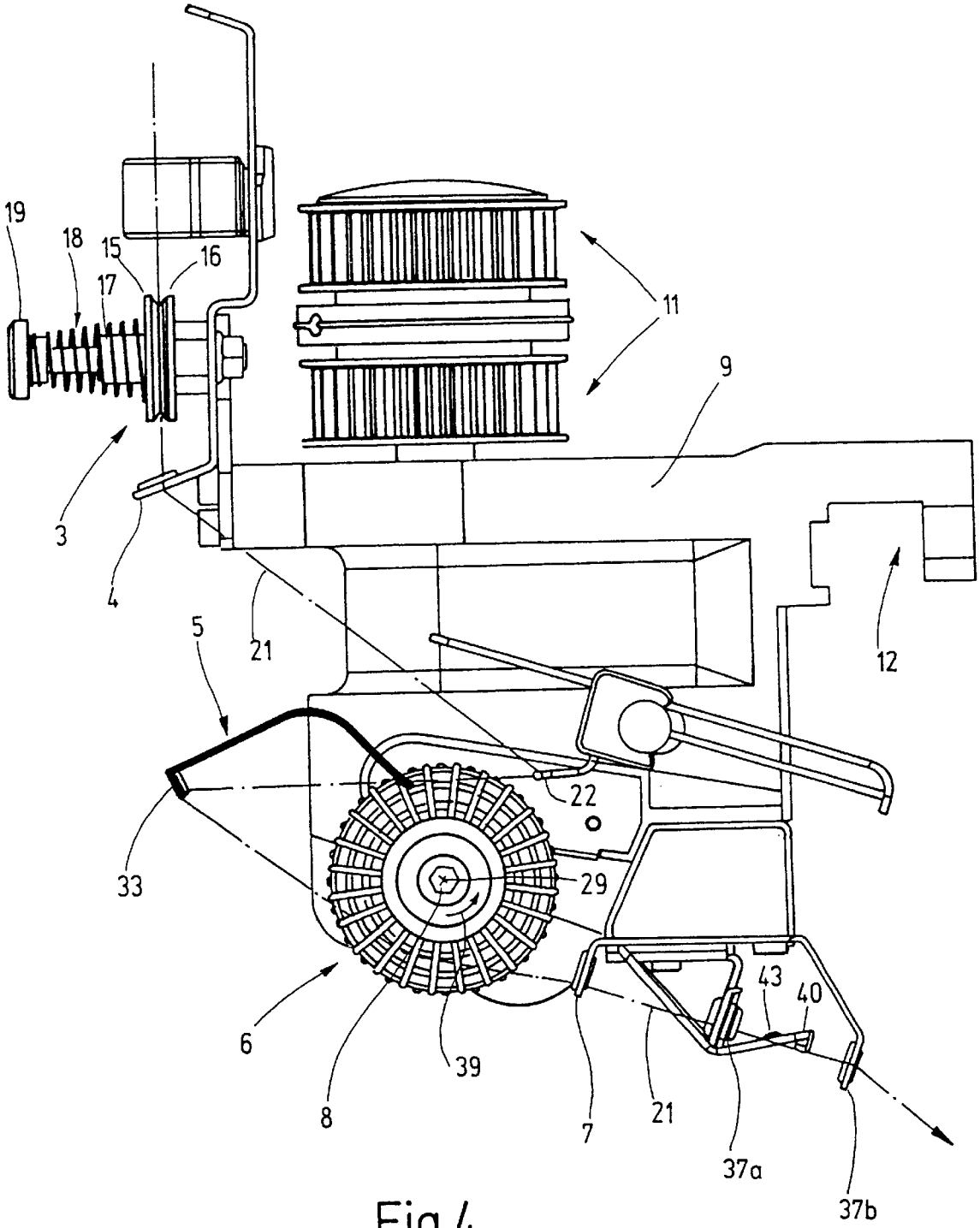

If the thread-processing machine continues to take up no or insufficient amounts of thread 21, the thread guide lever 5 can pivot out more and remove the eye 33 farther from the thread feed wheel 6 and its axis of rotation 29, as can be seen in FIG. 4 in particular. The eye 33 is then in a position in which the thread 21 runs from the eye 22 to the eye 33 without touching the thread feed wheel 6 in the process. Thus, conveyance of the thread 21 is completely stopped and the thread 21 is "removed". No thread conveyance takes place. The thread 21 runs from the eye 33 over the thread feed wheel 6 to the thread guide eye 7 and through the further thread guide eyes 37*a* and 37*b* to the machine. But the wrap angle at the thread feed wheel 6 is so small that the friction between the thread 21 and the thread feed wheel 6 is not sufficient to pull the thread 21 along and thereby to pull the pivot lever 5 against the thread feed wheel. This lasts at least as long as the thread 21 is not under tension.

The eye 22 is maintained in continuous vibration by the eccentric mechanism (vibration generator 28) illustrated in FIG. 5. This is of special importance, in particular when removing the thread 21, i.e. in the course of the abrupt change between the operating position in accordance with FIG. 2, in which the thread 21 is conveyed, and the operating position in accordance with FIG. 4, in which no thread is conveyed. If the thread consumption is suddenly stopped in the downstream-connected machine, the thread 21 initially still rests against the thread feed wheel 6. Because of its adhesion to the thread feed wheel 6, there can be a certain tendency of the thread feed wheel 6 to take along the thread not accepted by the downstream-connected machine in the direction 39 of rotation, so that the thread guide lever 5 would be prevented from removing the thread 21. But the vibration of the thread guide eye 22 is transmitted to the thread 21 and prevents the latter from adhering to the thread feed wheel 6. Because of this, the thread 21 can be immediately detached from the thread feed wheel 6 when the thread consumption is reduced. By means of this step in particular it is possible to make do with comparatively low forces at the thread guide lever 5 and therefore to deliver threads 21 which are and should be under only little tension. It is moreover possible to process critical threads, which otherwise would tend to strongly adhere to the thread feed wheel 6. This also applies to thread feed wheels 6 which, in place of the structure shown, have a cylindrical, plastic- or rubber-coated surface. The vibration of the thread aids the feeding of the thread against the checking force of the thread brake 3, and therefore the removal process.

Deviating from the above described embodiments, vibrations can also be transmitted to the vibration friction feed wheel mechanism 1. For example, the thread can be briefly deflected by means of a pin or other element, or vibration can be applied to it, wherein it is immaterial in most cases at which location between the thread brake 3 and the thread feed wheel the vibrational movement is imparted to the thread 21.

Figure 6:
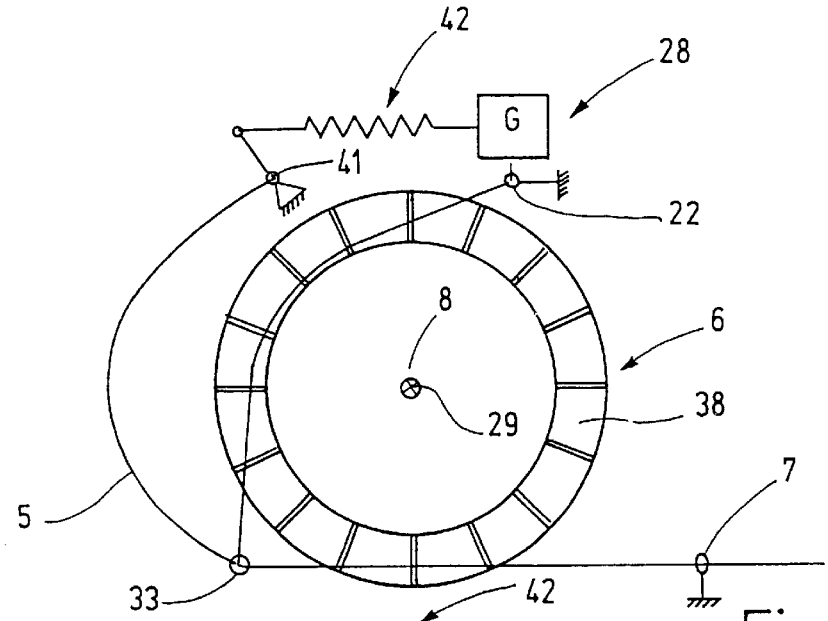
FIGS. 6 to 9, vibration feed wheel mechanisms in different embodiments and each in a schematic representation, and FIGS. 10 to 12, vibration generating devices in different embodiments and each in a schematic representation.

As schematically represented in FIG. 6, the vibration can also be introduced to the thread guide lever 5. To this end it is possible, for example, to initially seat the thread guide lever 5 on a hinge point 41, which is seated fixed in place, wherein the thread guide lever 5 is connected to a pre-stressing spring 42. The latter can be suspended from the vibration generator 28, so that the vibrations reach the eye 33 of the thread guide lever 5 in the end. The vibration-capable system constituted by the pre-stressing spring 42 and the thread guide lever 5 can be tuned to resonance or outside of the latter. In this embodiment, the thread feed wheel 6 is rotatably seated on a seating device, which is seated fixed in place. The thread guide eyes 7 and the eyes 22 are also seated fixed in place.

Figure 7:
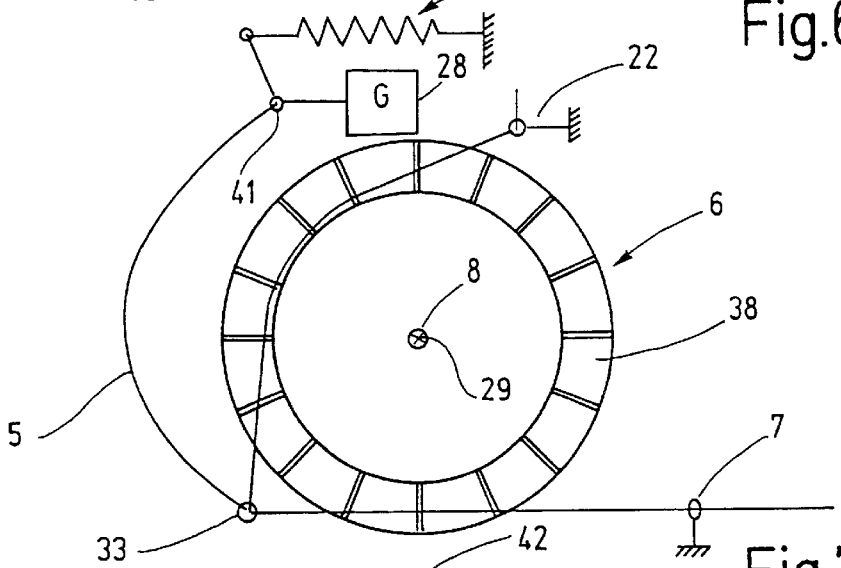

The same applies to the embodiment in accordance with FIG. 7, wherein again the thread guide lever 5 is subjected to vibrations. The vibration generator 28 is again used for this purpose and acts on the hinge point 41 of the thread guide lever. But in contrast thereto, the pre-stressing spring 42 is supported at a suspension point which is fixed in place. Here, again, resonance tuning is possible, as well as an operation of the vibration generator 28 at a frequency different from the resonance frequency which the thread guide lever 5 determines by means of the pre-stressing spring 42.

Deviating from this, it is possible to omit the pre-stressing spring 42, if the thread guide lever 5 is itself resiliently embodied and is not pivotably connected with the vibration generator 28. A rigid connection, for example, can be provided. Again, the excitation of the natural resonance of the thread guide lever 5 is possible. In the cases represented, the eye 33 can vibrate in the plane in which the thread 21 runs. This would be the plane of projection in FIGS. 6 and 7. If needed, the vibration can also be directed transversely to the direction of thread travel, or it can be circularly polarized. Chronologically changing vibration directions can also result. It is important that the thread 21 be charged with vibrations in such a way that it does not adhere to the thread feed wheel 6, but that the frictional adherence is disrupted at least at the detachment point.

Figure 8:
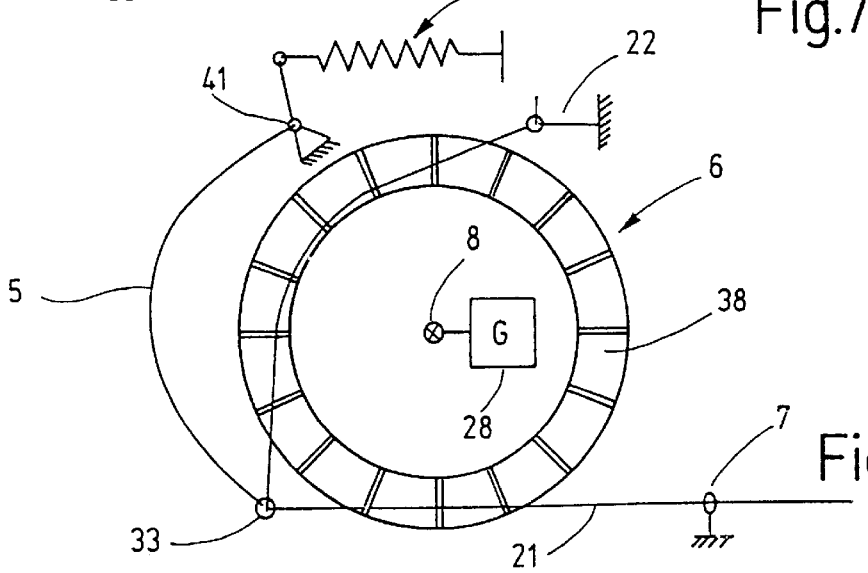

This can also be achieved by the embodiment in accordance with FIG. 8, wherein the seating device of the thread feed wheel 6, i.e. the shaft 8 in particular, is acted upon by vibrations. The remaining elements are again seated fixed in place. The pivotably seated thread guide lever 5 is also not acted upon by vibrations. However, the detachment of the thread 21 from the contact surface 38 is aided by the application of vibration, in particular to the contact place of the thread 21 running off the thread feed wheel 6.

Figure 9:
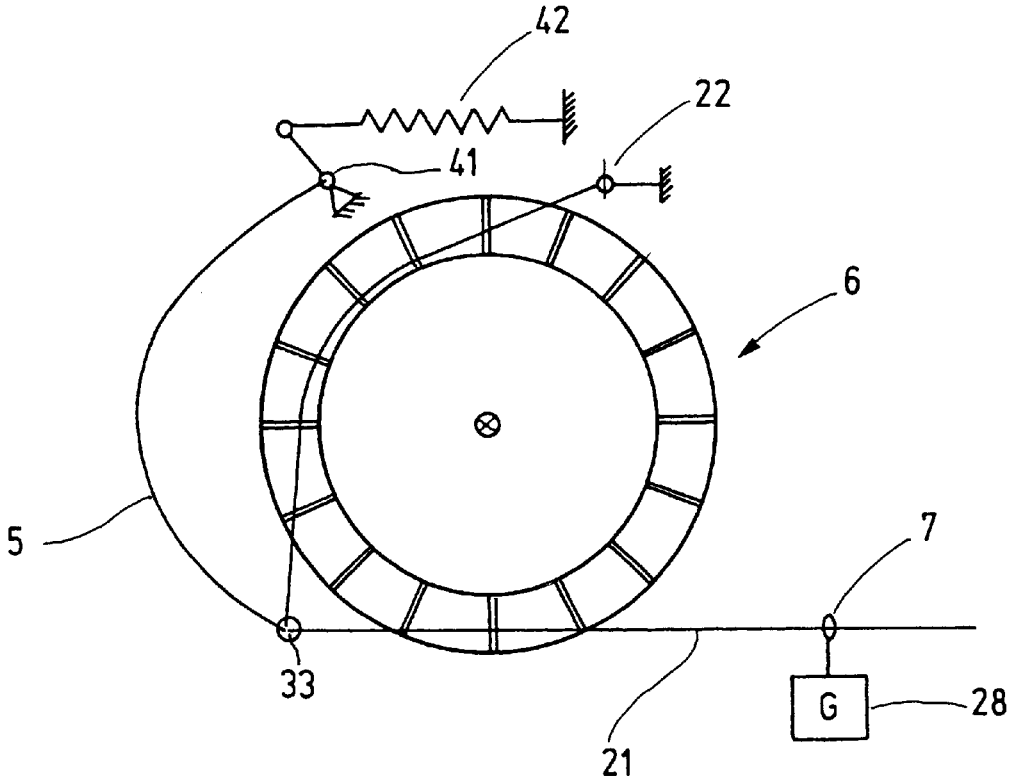

This also applies to the embodiment in accordance with FIG. 9, wherein the vibration acts on the thread guide eye 7. However, in this case the detachment of the thread 21 from the thread feed wheel 6 can be somewhat weaker in respect to the previously described embodiments. The reason for this can be the reduced vibration transmission from the thread guide eye 7 via the thread 21 to the contact point between the thread feed wheel 6 and the thread 21 which occurs, if the thread 21 is not maintained tight.

Figure 10:
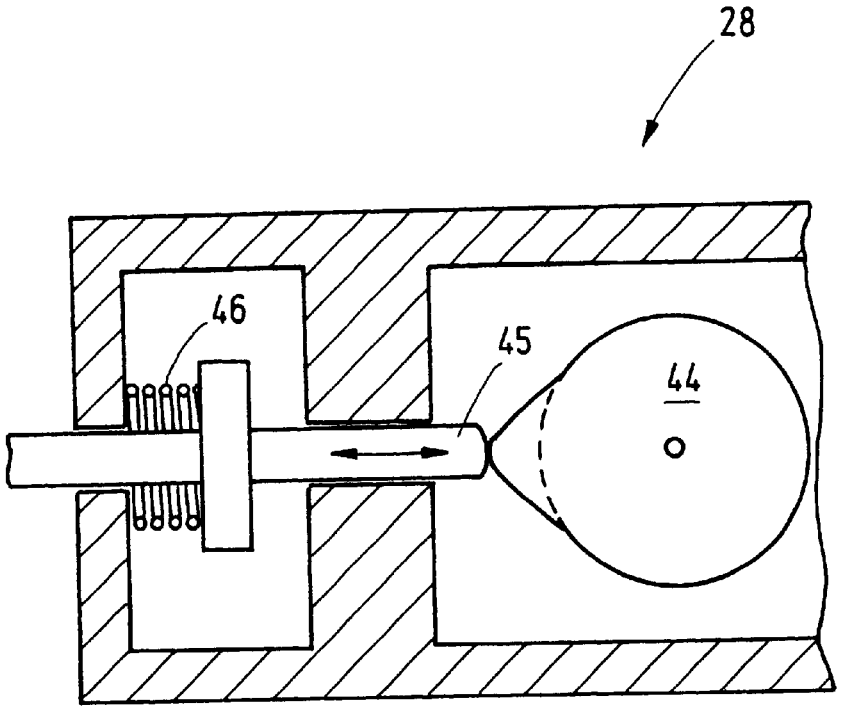

In principle, the vibration generator can be differently constructed. In accordance with FIG. 5, it can be constituted by the arrangement of an eccentric device. FIG. 10 illustrates an alternative embodiment, wherein a driven cam 44 periodically hits a tappet 45 in order to impart a short stroke on the latter. The tappet 45 can be pre-stressed by means of a spring 46 against the cam 44. The cam 44 can rotate synchronously with the thread feed wheel 6, but if required also at greater or lesser numbers of revolutions. Moreover, it can generate several strokes per revolution if, varying from the representation in FIG. 10, it has several protrusions.

Figure 11:
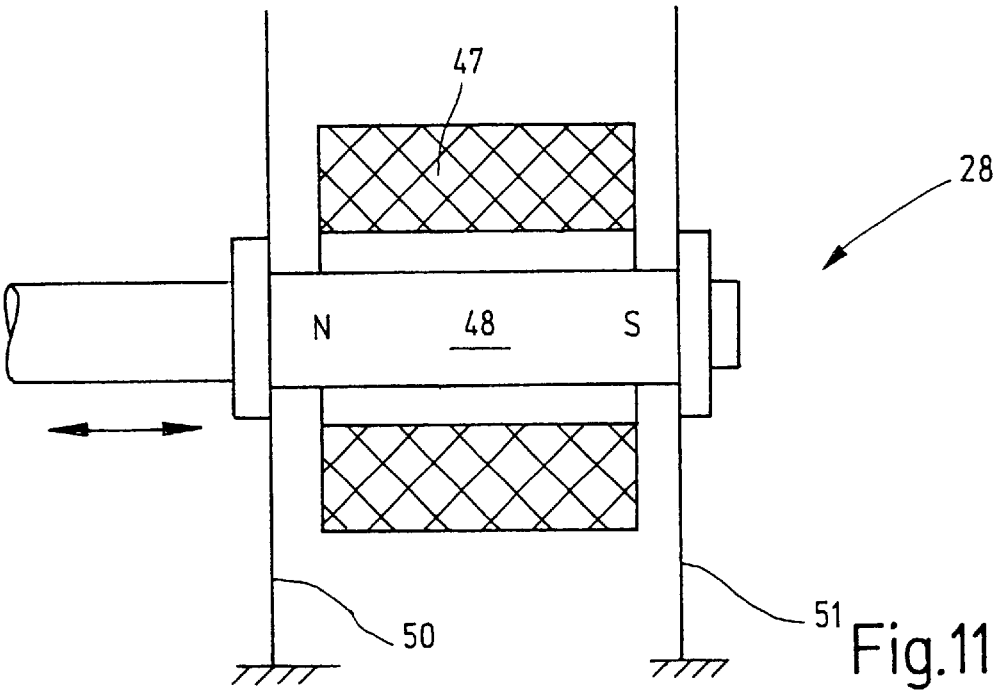

Further than that, an electrical vibration generation is possible. FIG. 11 schematically illustrates such a vibration generator 28, which has a magnetic coil 47, which is seated fixed in place. Its core 48 is for example magnetically polarized (north pole N, south pole S), and has been suspended, for example by resilient strips or diaphragms 50, 51, in an axially displaceable manner. If an a.c. voltage is applied to the magnetic coil 47, the armature 48 swings in the direction of the arrow indicated in FIG. 11. The arrangement can be tuned to resonance, as well as outside of resonance, and can be used for applying vibrations to the individual elements in accordance with FIGS. 6 to 9, or also FIG. 5. The application of the vibrations can take place permanently or periodically over time.

Figure 12:
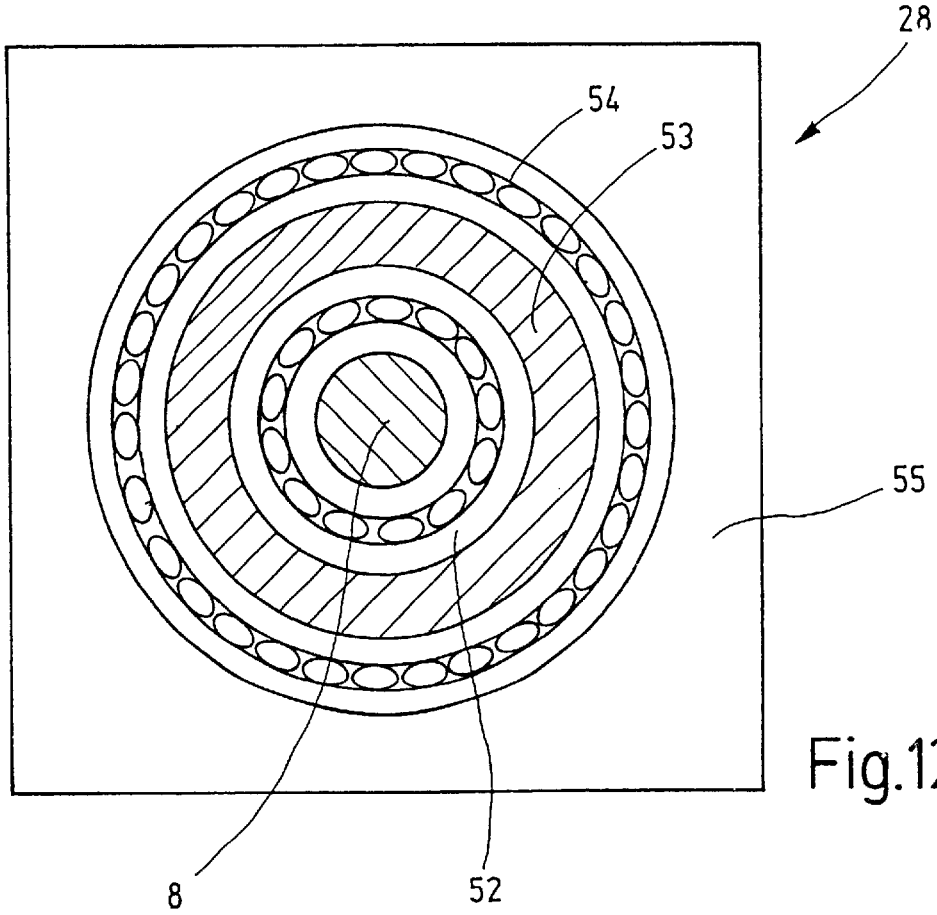

A vibration generator 28 in accordance with FIG. 12 is designed for generating a rotary vibration. The latter can for example be used as a bearing device for a thread feed wheel 6. Here, the shaft 8 is seated in a bearing 52, which is held by means of an eccentric 53. The eccentric 53 is held on a bearing receiver 55, fixed in place, via a further bearing 54. Independently of the intrinsic rotation of the shaft 8, a rotation of the eccentric 53 guides it on an orbiting path, such as indicated by an arrow 56 next to it in FIG. 12. The radius of this orbital movement is preferably relatively short and lies in the range of a vibration amplitude of approximately 1 mm. In this case the orbital movement can have a number of orbits which differs from the number of revolutions of the thread feed wheel. Numbers of orbits which are larger than the number of revolutions of the thread feed wheel 8 are preferred.

In connection with a vibration friction feed wheel mechanism 1, having a thread guide lever 5 for inserting and removing a thread 21, the application of vibrations to the thread guide elements 22, 33, 7, or the application of vibrations to the thread feed wheel 6, is used to improve the removal properties of the friction feed wheel mechanism 1.

What is claimed is:

1. A friction feed wheel mechanism for feeding in at least one thread, the friction wheel mechanism comprising, in combination, at least one thread guide element, through which or against which the thread rests during operation, or along which the thread runs during operation, at least one thread feed wheel, which is seated so that the thread wheel feed is rotatable around a predetermined axis of rotation by way of a support arrangement arranged on a support, the support being designed to be connected with a thread processing mechanism, the thread feed wheel including a contact surface for the frictionally connected conveyance of the thread, a thread guide lever, which is seated on the support by way of a bearing device and which supports a yarn guide element, whose position affects the frictional connection between the thread and the contact surface, and a vibration generating arrangement (28) for applying a vibrational movement to the thread.

2. The friction feed wheel mechanism in accordance with claim 1, wherein the vibration generating arrangement is connected with the bearing device in order to impart a vibrational movement to the thread guide lever.

3. The friction feed wheel mechanism in accordance with claim 1, wherein the thread guide lever comprises a pivot lever, which supports the thread guide element on its free end, so that the thread guide element can be moved toward or away from the thread feed wheel by pivoting the thread guide lever, and that the thread guide lever is pivotably seated by means of the bearing device.

4. The friction feed wheel mechanism in accordance with claim 1, wherein the thread guide lever is resilient.

5. The friction feed wheel mechanism in accordance with claim 1, wherein the vibration generating arrangement is connected with the bearing device in order to impart to the thread guide lever a vibrational movement which is oriented transversely to its pivot axis.

6. The friction feed wheel mechanism in accordance with claim 1, wherein the friction feed wheel mechanism includes a thread brake, which checks the thread running to the thread feed wheel, and the vibration generating arrangement is connected with an element, which is arranged between the thread brake and the thread feed wheel and is in contact with the thread at least over a short interval in order to impart a vibrational movement to the thread.

7. The friction feed wheel mechanism in accordance with claim 1, wherein the contact surface of the thread feed wheel is an interrupted surface.

8. The friction feed wheel mechanism in accordance with claim 1, wherein the contact surface of the thread feed wheel is defined by strips.

9. The friction feed wheel mechanism in accordance with claim 8, wherein pairs of adjoining strips together enclose an angle.

10. The friction feed wheel mechanism in accordance with claim 1, further including an inlet thread guide element which is located upstream of the thread feed wheel, and an outlet thread guide element which is arranged downstream of the thread feed wheel, wherein the inlet thread guide element and the outlet thread guide element are accessible from a defined operating side of the thread feed device, and are fixed on a circumferential section facing the operating side at the thread of the wheel.

11. The friction feed wheel mechanism in accordance with claim 1, wherein the vibration generating arrangement is connected with the bearing device in order to impart a vibrational movement to the thread feed wheel.

12. The friction feed wheel mechanism in accordance with claim 1, wherein the vibration generating arrangement is connected with the bearing device in order to impart a vibrational movement to the thread guide element.

13. The friction feed wheel mechanism in accordance with claim 1, wherein the vibration generating arrangement is connected with the support arrangement in order to impart a vibrational movement to the thread guide lever.

14. The friction feed wheel mechanism in accordance with claim 1, wherein the vibration generating arrangement is connected with the support arrangement in order to impart a vibrational movement to the thread feed wheel.

15. The friction feed wheel mechanism in accordance with claim 1, wherein the vibration generating arrangement is connected with the support arrangement in order to impart a vibrational movement to the thread guide element.

16. The friction feed wheel mechanism in accordance with claim 1, wherein the vibration generating arrangement is connected with the thread guide element in order to impart a vibrational movement to the thread guide lever.

17. The friction feed wheel mechanism in accordance with claim 1, wherein the vibration generating arrangement is connected with the thread guide element in order to impart a vibrational movement to the thread feed wheel.

18. The friction feed wheel mechanism in accordance with claim 1, wherein the vibration generating arrangement is connected with the thread guide element in order to impart a vibrational movement to the thread guide element.

* * * * *